US007829012B2

(12) United States Patent
Bischoff et al.

(10) Patent No.: US 7,829,012 B2
(45) Date of Patent: Nov. 9, 2010

(54) ENHANCEMENT OF THERMAL STABILITY OF POROUS BODIES COMPRISED OF STAINLESS STEEL OR AN ALLOY

(75) Inventors: Brian L. Bischoff, Knoxville, TN (US); Theodore G. Sutton, Kingston, TN (US); Roddie R. Judkins, Knoxville, TN (US); Timothy R. Armstrong, Clinton, TN (US); Kenneth D. Adcock, Harriman, TN (US)

(73) Assignee: Worldwide Energy, Inc. of Delaware, Oak Ridge, TN (US)

( * ) Notice: Subject to any disclaimer, the term of this patent is extended or adjusted under 35 U.S.C. 154(b) by 374 days.

(21) Appl. No.: 11/305,974

(22) Filed: Dec. 19, 2005

(65) Prior Publication Data

US 2007/0140890 A1 Jun. 21, 2007

(51) Int. Cl.
*B22F 7/00* (2006.01)
*B22F 1/00* (2006.01)

(52) U.S. Cl. ..... 419/7; 75/211

(58) Field of Classification Search ..... 419/7; 75/211

See application file for complete search history.

(56) References Cited

U.S. PATENT DOCUMENTS

| | | | | |
|---|---|---|---|---|
| 3,052,967 | A | 9/1962 | Fischer | |
| 6,881,703 | B2 * | 4/2005 | Cutler et al. | 502/439 |
| 2003/0100448 | A1 | 5/2003 | Cutler et al. | |

FOREIGN PATENT DOCUMENTS

| | | |
|---|---|---|
| EP | 0351056 | 1/1990 |
| GB | 2271781 A | 4/1994 |

* cited by examiner

*Primary Examiner*—Roy King
*Assistant Examiner*—Jie Yang
(74) *Attorney, Agent, or Firm*—Michael E. McKee

(57) ABSTRACT

A method for treating a porous item constructed of metal powder, such as a powder made of Series 400 stainless steel, involves a step of preheating the porous item to a temperature of between about 700 and 900° C. degrees in an oxidizing atmosphere and then sintering the body in an inert or reducing atmosphere at a temperature which is slightly below the melting temperature of the metal which comprises the porous item. The thermal stability of the resulting item is enhanced by this method so that the item retains its porosity and metallic characteristics, such as ductility, at higher (e.g. near-melting) temperatures.

6 Claims, 1 Drawing Sheet

ENHANCEMENT OF THERMAL STABILITY OF POROUS BODIES COMPRISED OF STAINLESS STEEL OR AN ALLOY

This invention was made with Government support under Contract No. DE-AC05-00OR22725 awarded by the U.S. Department of Energy to UT-Battelle, LLC, and the Government has certain rights to the invention.

BACKGROUND OF THE INVENTION

This invention relates generally to items made from metallic powders and relates, more particularly, to the formation and treatment of porous items comprised of powdered stainless steel or any alloy which forms an oxide surface, such as chromium oxide, aluminum oxide, or silicon oxide, on oxidation.

Porous items constructed of powdered metals and with which this invention is concerned are commonly utilized in applications which rely upon the porous nature of the item for the item to operate in its intended manner. Such items can include, for example, filters, membrane supports or substrates, and fuel cell supports and can be formed with processes involving molding, extrusion, casting or isostatic compression. Heretofore, however, when such an item is used or undergoes processing at relatively high temperatures, i.e. within 200 and 300 C. degrees of the melting temperature of the material which comprises the item, the item becomes non-porous (or its porosity closes, i.e. it becomes no longer interconnected) and thereafter cannot operate in its intended manner or continue to be processed. Such a loss of porosity in the item is due, at least in part, to the exposure of the relatively large surface areas possessed by the item to the relatively high temperatures.

Some stainless steels, and in particular Series 400 stainless steels, have melting temperatures which fall within the range of between about 1370° C. and 1530° C. depending upon the specific composition of the steel in this class. Therefore, an item formed with a conventionally-processed stainless steel of this class is likely to experience a loss in porosity when exposed to a temperature as low as about 1200° C.

It would therefore be desirable to provide a method for treating a porous metallic body which enhances the thermal stability of the body when exposed to temperatures which approach the melting temperature of the material which comprises the body.

Accordingly, it is an object of the present invention is to provide a new and improved method for processing a porous metallic item which imparts to the item a thermal stability which prevents the item from losing its porosity when exposed to temperatures which are within about 200 and 300 C. degrees of the melting temperature of the item.

Another object of the present invention is to provide such a method which enables the processed item to retain many of its desirable metallic properties, such as its ductility, at these relatively high, near-melting temperatures.

Still another object of the present invention to provide such a method which is particularly well-suited for processing a porous item comprised of stainless steel, and in particular, Series 300 and Series 400 stainless steel, or an alloy that forms a surface oxide, such as chromium oxide, aluminum oxide, or silicon oxide, on oxidation.

Yet another object of the present invention is to provide such a method which is uncomplicated to perform, yet is effective in operation.

SUMMARY OF THE INVENTION

This invention resides in a method for treating a porous item constructed of a stainless steel powder or a metal alloy powder which forms a surface oxide, such as chromium oxide, aluminum oxide or silicon oxide, upon oxidation.

The method includes the steps of preheating the porous item in an oxidizing atmosphere so that an oxide layer is formed upon the surfaces of the porous item and then sintering the body in an inert or reducing atmosphere.

In one embodiment of the method, the preheating step preheats the porous item to a temperature of between about 700° C. and 900° C., and in another embodiment of the method, the sintering step is conducted at a temperature which approaches the melting temperature of the material which comprises the item.

DETAILED DESCRIPTION OF AN ILLUSTRATIVE EMBODIMENT

Figure 1:
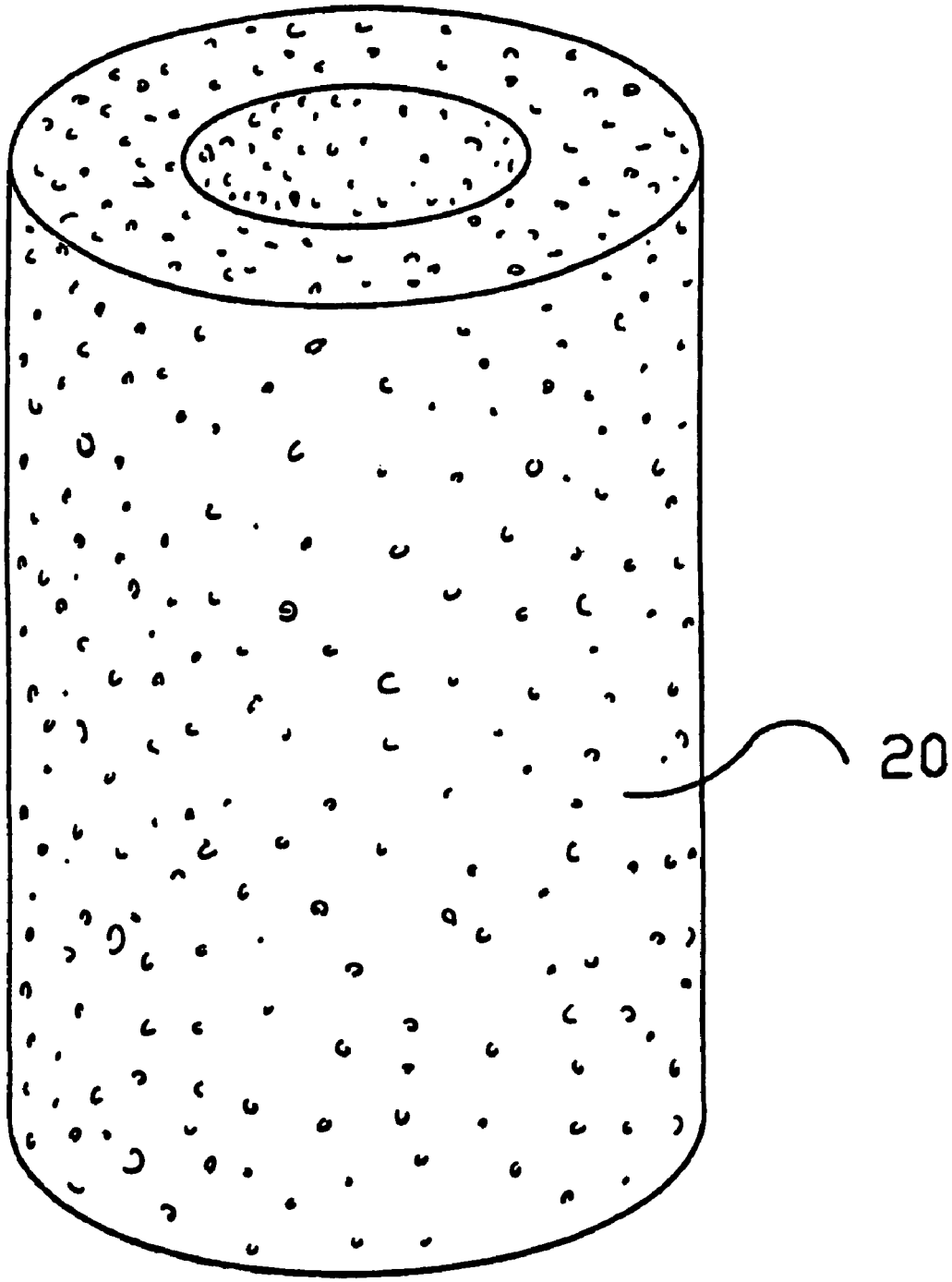
FIG. 1 is a perspective view of an item which has been constructed and treated in accordance with an embodiment of the method of the present invention.

Turning now to the drawings in greater detail and considering first FIG. 1, there is illustrated a porous item, generally indicated 20, which has been treated in accordance with an embodiment of the method of the present invention to render the item 20 thermally stable at temperatures which approach the melting temperature of the item 20.

The depicted item 20 is comprised of a porous body of Series 400 stainless steel material which can be constructed by any of a number of methods. For example, the item 20 can be initially constructed with a mixture of stainless steel powder (which possesses the constituents of Series 400 stainless steel material) and binder and which is subsequently formed into a body having a shape which conforms to the shape of the desired item 20. Such a forming step can be effected, for example, in a molding operation, an extrusion process, a casting operation or by isostatic compression. Once the mixture of powder and binder is formed into the desired shape, the binder is volatized in a manner which is well known in the art to leave the body comprised primarily of the stainless steel material and which renders the body porous. Such a volatization of the binder can take place, for example, in air and at low temperature. Upon completion of the volatization of the binder, the body is in condition to be treated in accordance with the method of the invention.

To this end, the body is preheated to form a surface coating on the body. To this end, the body is positioned within the controlled environment, such as that of a tube furnace or a muffled furnace, and then preheated within an oxidizing atmosphere. Such an oxidizing atmosphere can be air, and in experiments performed to date, the temperature of this preheating stage has ranged between about 700° C. and 900° C.

Applicants have found that the higher the preheating temperature, the thicker the oxide layer that is likely to accumulate upon the surfaces of the porous body. With this in mind, the oxide layer which accumulates upon the surfaces of the body should not be so thick that the processed item does not function in the manner in which it is intended. Accordingly, it is preferable that the oxide layer be limited in thickness (by either limiting the preheating temperature to a value near the lower end of the range of between 700 and 900° C. or limiting the time of exposure of the body to the oxidizing atmosphere) so that the oxide layer does not become so thick that the ultimately-processed item 20 fails to operate in its intended manner.

Upon completion of the preheating step, the body is then sintered in an inert or a reducing atmosphere at a relatively high temperature (e.g. within the range of between about 1250° C. and 1500° C.). To this end, the controlled environment within which the body is positioned is evacuated of the oxidizing atmosphere (e.g. air) and an inert substance, such as argon, or a reducing substance, such as hydrogen or an argon-hydrogen mixture, is introduced into the controlled atmosphere, and the body is heated to a temperature at which the contacting particles of the powdered stainless steel bond together. Preferably, the temperature at which the body is sintered approaches, but does not exceed, the melting temperature of the stainless steel which comprises the body. It will be understood, however, that several factors, such as particle size of the stainless steel powder comprising the body and the extent of oxidization from the preheating (i.e. pre-oxidation) step, which can affect the melting temperature of the body.

As the body is exposed to the relatively high temperatures of the sintering step, the oxide layer which forms upon the surfaces of the body during the preheating step helps prevent the body from losing its porosity. Upon completion of the sintering step, the method of the invention is considered as complete, although it may be desired that the resulting product, or item 20, undergo additional processing steps before it is used in its intended manner.

The method of this invention results in the enhancement of the thermal stability of the item 20. More specifically, the method enhances the thermal stability of the item 20 so that when the item 20 is exposed to, used at or processed at high temperatures which approach the melting temperature of the material which comprises the item 20, the item 20 does not loose its porosity nor does its porosity close or become disconnected.

Test Results

Porous disks have been formed by applicants from type 410 stainless steel and sintered under varying conditions, i.e. conditions indicated in TABLE 1 below:

TABLE 1

| Air Oxidation Temp' (° C.) | Sintering time (min) at 1320° C. in Ar | Porosity |
|---|---|---|
| 530 | 60 | <10% |
| 700 | 60 | 19.99% |
| 800 | 60 | 34.70% |
| 800 | 120 | 34.54% |

The discs were first held in air at temperatures ranging from about 530° C. to about 800° C. for one hour and then ramped to the final sintering temperatures of about 1320° C. in argon. The sample which was air-oxidized at 530° C. had very little porosity and no measurable permeability. By comparison, the samples which were air-oxidized at 800° C. indicated that increasing the exposure time at the final (sintering) temperature has little effect on the properties of the sample.

It follows from the foregoing that a method has been described for enhancing the thermal stability of a porous body comprised of metal capable of being oxidized. To this end, the porous item is preheated in an oxidizing atmosphere so that an oxide layer is formed upon the surfaces of the porous item and then the body is sintered in an inert or reducing atmosphere.

It will be understood that numerous modifications and substitutions can be had to the aforedescribed embodiment without departing from the spirit of the invention. For example, although the aforedescribed embodiment has been shown and described as involving a Series 400 stainless steel material, the method can be performed on other materials, such as Series 300 stainless steel and any metal alloy that forms a surface oxide, such as chromium oxide, aluminum oxide, or silicon oxide, upon oxidation. Accordingly, the principles of the present invention can be variously applied, and the aforedescribed embodiment is intended for the purpose of illustration and not as limitation.

The invention claimed is:

1. A method for heat treating of a porous item constructed of powdered stainless steel which forms a surface oxide upon oxidation, the method comprising the steps of:

preheating the porous item in the absence of a binder material and in an oxidizing atmosphere so that an oxide layer is formed upon the surfaces of the stainless steel of the porous item for enhancing the thermal stability of the item when subsequently exposed to temperatures which approach the melting temperature of the material which comprises the item and wherein this preheating step is conducted at a temperature of between 700° C. and 900° C.; and then sintering the item in an argon atmosphere at a temperature which approaches the melting temperature of the material which comprises the item.

2. The method as defined in claim 1 wherein:

The preheating step is conducted in an oxidizing atmosphere of about 800° C. so that an oxide layer is formed upon the surfaces of the stainless steel of the porous item; and The sintering step is conducted in an argon atmosphere at about 1320° C.

3. The method as defined in claim 2 wherein the porous item has a porosity of about 34 percent following the sintering step.

4. A method for heat treating of a porous item constructed of series 300 or 400 stainless steel powder which forms a surface oxide upon oxidation, the method comprising the steps of:

preheating the porous item in the absence of a binder material to a temperature of between about 700° C. and 900° C. in an oxidizing atmosphere so that an oxide layer is formed upon the surfaces of the stainless steel powder of the porous item for enhancing the thermal stability of the item when subsequently exposed to temperatures which approach the melting temperature of the material which comprises the item; and then sintering the item in an argon atmosphere at a temperature which approaches the melting temperature of the material which comprises the item.

5. The method as defined in claim 4 wherein the step of sintering is conducted in a controlled environment.

6. In a process for heat treating of a porous metallic body following the formation of the porous body from a powder comprised of series 300 or 400 stainless steel which, upon oxidation, forms upon oxidation a surface oxide including an oxide selected from group consisting of chromium oxide, aluminum oxide or silicon oxide, the improvement comprising:

heating the body in the absence of a binder material and in an oxidizing atmosphere so that an oxide layer is formed upon the surfaces of the porous body for enhancing the thermal stability of the body when subsequently exposed to temperatures which approach the melting temperature of the material which comprises the body and wherein this preheating step is conducted at a temperature of between about 700° C. and 900° C.; and then sintering the body in an argon atmosphere at a temperature which approaches the melting temperature of the material which comprises the body.

* * * * *